US008517610B2

(12) United States Patent
Arcot

(10) Patent No.: US 8,517,610 B2
(45) Date of Patent: Aug. 27, 2013

(54) FOLDABLE BAG WITH EXPANDABLE OPENING

(76) Inventor: Santosh Arcot, Naperville, IL (US)

( * ) Notice: Subject to any disclaimer, the term of this patent is extended or adjusted under 35 U.S.C. 154(b) by 336 days.

(21) Appl. No.: 12/878,789

(22) Filed: Sep. 9, 2010

(65) Prior Publication Data

US 2012/0063705 A1 Mar. 15, 2012

(51) Int. Cl.

| | |
|---|---|
| ***B65D 30/16*** | (2006.01) |
| ***B65D 33/00*** | (2006.01) |
| ***B65D 30/20*** | (2006.01) |
| ***B65B 1/04*** | (2006.01) |
| ***B65B 67/04*** | (2006.01) |

(52) U.S. Cl.
USPC ..... 383/104; 383/36; 383/120; 141/391; 248/99

(58) Field of Classification Search
USPC ..... 383/33–34.1, 120, 907; 248/99; 141/390, 391; 229/186–188, 101, 123, 170
See application file for complete search history.

(56) References Cited

U.S. PATENT DOCUMENTS

| | | | | |
|---|---|---|---|---|
| 1,234,057 | A * | 7/1917 | McIntyre | 141/314 |
| 2,833,460 | A * | 5/1958 | Votolato | 383/36 |
| 3,062,428 | A * | 11/1962 | Oettinger | 206/515 |
| 4,036,423 | A * | 7/1977 | Gordon | 229/125.34 |
| 5,271,589 | A | 12/1993 | Belous | |
| D361,185 | S | 8/1995 | Seiler et al. | |
| 5,836,696 | A * | 11/1998 | Schnell | 383/120 |
| 6,085,647 | A | 7/2000 | Burow | |
| 6,116,548 | A | 9/2000 | Oleson | |
| 7,302,978 | B1 * | 12/2007 | Kolarik | 141/391 |
| 7,736,057 | B2 * | 6/2010 | VanBost | 383/33 |
| 7,866,538 | B2 * | 1/2011 | Liao et al. | 229/101 |
| 2008/0029658 | A1 | 2/2008 | Vanbost | |
| 2008/0273818 | A1 | 11/2008 | Tarasuk et al. | |

* cited by examiner

*Primary Examiner* — Jes F Pascua
(74) *Attorney, Agent, or Firm* — McDonnell Boehnen Hulbert & Berghoff LLP

(57) ABSTRACT

Disclosed herein is a method for making an adapter piece for ordinary bags or a specialized bag that creates a larger opening, while maintaining the same form-factor of the original bag. The incorporation of this adapter piece to ordinary bags allows for easy loading of the bag and provides additional rigidity to the mouth of the bag. Additionally, this modification can easily be incorporated into standard manufacturing process for conventional paper bags.

13 Claims, 13 Drawing Sheets

FOLDABLE BAG WITH EXPANDABLE OPENING

FIELD OF THE INVENTION

The invention relates to a foldable bag having an upper portion that is expandable to provide a larger opening to the bag, as well as methods of manufacture of such an upper portion and bags having such an upper portion.

BACKGROUND

Ordinary free standing paper bags have become very popular in all facets of day-to-day life. Some bags are often used in the retail and food industries for packing of items such as groceries and food items from restaurants and take-out services, as well in the household waste industry for disposal of leaves, grass clippings and other biodegradable items. These bags are very simple in design and therefore easy to manufacture in large quantities and in an economical manner.

Such paper bags are generally foldable into a relatively flat rectangular form that is compact in size, so that they can transported and sold more conveniently. In particular, two opposing sides of the bag are typically folded inward, collapsing the cavity of the bag so the other two opposing sides are brought together and centered perpendicularly above the base of the bag. Once the two opposing sides are brought together, the base of the bag can then be pivoted around the sides so that it is substantially parallel with the sides, and together with the sides forms a substantially flat rectangular shape. Bags folded into such a flat shape are typically stacked and packaged so that they can be sold in quantity.

In order to use the bag for its intended purpose, the bag is generally unfolded to create a vertical standing bag with a rectangular cavity and a base as the support for the bag. The simple design provides sufficient rigidity to the bag, but also allows the bag to collapse easily due to the folds in the vertical sides of the bag. This design aspect may be particularly important in taller lawn and leaf bags. Other variants of this basic design also include handles for easy carrying of the bag containing its contents.

One issue with such bags, which may be particularly problematic in lawn bags, is tears in the top portion of the bag resulting from the act of loading the contents, particularly odd-shaped objects or slightly oversized items such as twigs or branches. Further, in the case of lawn bags, factors such as wind can make it difficult to load the load the bag when the sides of the bag collapse. The fixed opening dimension also makes it quite challenging to load items such as grass clippings and leaves. The bag can collapse upon itself resulting in partial or complete closure of the opening, which makes the act of loading the bag a frustrating experience. Furthermore, the act of transferring grass clippings into the paper bag directly using the receptacle unit that collects grass clippings generally attached behind the lawnmower can result in tears in the paper bag opening leading to spills and additional inconvenience and frustration.

None-the-less, this standard bag design has withstood the test of time without significant modifications to the opening dimensions and shape of the bag. One reason for this is the simple manufacturing process that easily enables production of large quantities of the existing design. A number of mechanisms and devices that can aid in filling of the paper lawn bags have been documented. Some of these are funnel-shaped devices that aid in loading the bag, (see e.g., U.S. Pat. Nos. 6,085,647 and 6,116,548), while others are rigid frames that are inserted into the bag (see e.g., U.S. Pat. No. 5,915,768) or around the mouth of the bag to keep the mouth open and prevent from collapsing (see e.g., U.S. Pat. No. 6,138,962). The variety of products that have been designed to address the explicit problem of the difficulty in loading the lawn bags is an indication of the importance of the problem and clear evidence of the need to alleviate this problem.

However, most of these devices or methods are items that have to be sourced separately and/or modified extensively for use with bags of other dimensions, and therefore necessitate additional expenditure of money and time. For instance, U.S. Pat. Nos. 6,085,647 and 6,116,548 demonstrate the use of a funnel-shaped hopper mounted on a stand that can be used to fill lawn bags placed below. It can be easily concluded that a bag of a different dimension or cross-section would necessitate a different hopper and stand design and dimensions. Likewise, U.S. Pat. No. 5,915,768 demonstrates a method of creating a funnel made out of plastic material that can be used for packing yard waste into a bag. U.S. Pat. No. 6,138,962 demonstrates a method to use a frame to keep the mouth of the bag open during the act of loading. None of these devices or methods forms an integral part of the bag itself. None of these existing solutions change the basic design of the bag that would serve the same purpose and provide all the benefits that are provided by these secondary devices or methods to create a wider and more rigid opening to the bag.

Overview

Disclosed herein are bags with an expandable opening, adapter pieces that can be used to convert standard bags into a bag with such an expandable opening, and methods of manufacturing such bags and adapter pieces. Such bags preferably take the form of free-standing paper lawn bags. However, the invention may be applied to bags constructed from materials other than paper, and designed for any use.

In an exemplary embodiment, an expandable upper portion of a bag (which may also serve as an adapter piece for a standard bag when manufactured separately) is manufactured from a contiguous strip of paper that is cut, folded, and attached to a lower portion of the bag, in order to provide an expandable opening to the bag. In particular, the upper portion is formed from a unique geometrical shape comprising of rectangular-shaped sections connected by triangular-shaped sections that can be folded at specific locations such that the geometrical shape as a whole folds into a linear piece. Preferably, the expandable upper portion of the bag includes creases that allow the upper portion to be folded such that: (1) when unfolded, the upper portion provides an enlarged opening to the bag and (2) when folded, aligns the upper portion of the bag with the lower portion such that the upper portion maintains the same form-factor as a standard rectangular bag (i.e., a four-sided bag having a rectangular cavity), and is further foldable to be flattened in the same manner as a standard rectangular bag. Furthermore, the design of the geometrical shape and process by which it is folded and creased to form the upper portion of the bag, makes it easier to be incorporated into standard manufacturing process for such bags.

These as well as other aspects, advantages, and alternatives, will become apparent to those of ordinary skill in the art by reading the following detailed description, with reference where appropriate to the accompanying drawings.

BRIEF DESCRIPTION OF THE DRAWINGS

An exemplary embodiment of the present invention is described herein with reference to the drawings, in which.

DETAILED DESCRIPTION

Exemplary embodiments of the present invention are described herein. It should be understood that the word "exemplary" is used herein to mean "serving as an example, instance, or illustration." Any embodiment described herein as "exemplary" is not necessarily to be construed as preferred or advantageous over other embodiments. Further, those skilled in the art will understand that changes and modifications may be made to these embodiments without departing from the true scope and spirit of the invention, which is defined by the claims.

A bag according to an exemplary embodiment has a rectangular lower portion and an expandable upper portion that can be expanded to provide a larger opening to the bag. The lower portion preferably has inner walls that define a tubular cavity, while the foldable upper portion preferably has inner walls that define an upper cavity that varies in form depending upon whether or not the upper portion is expanded. When the upper portion of the bag is not expanded, the upper cavity preferably is tubular, and in an exemplary embodiment, is a rectangular cavity that is simply an extension of a rectangular cavity of the lower portion. However, when the upper portion is expanded, the upper cavity is preferably funnel-shaped, with a larger opening at the top of the bag.

As used herein, the term "cavity" shall mean any three-dimensional air-space within a structure that is enclosed on at least four sides by the structure. A cavity may be open-ended (i.e., not enclosed) on one or both ends of the structure (i.e., not enclosed by a bottom section and/or top section of the structure). A "tubular" cavity shall be understood to mean a cavity defined by side walls and having a cross-section of any shape (e.g., circular, rectangular, etc.), where the cross-sectional area is constant throughout the cavity. A "funnel-shaped" cavity shall be understood to mean a cavity defined by sloping side walls and having a cross-section of any shape, where the cross-sectional area increases/decreases throughout the cavity.

Figure 2:
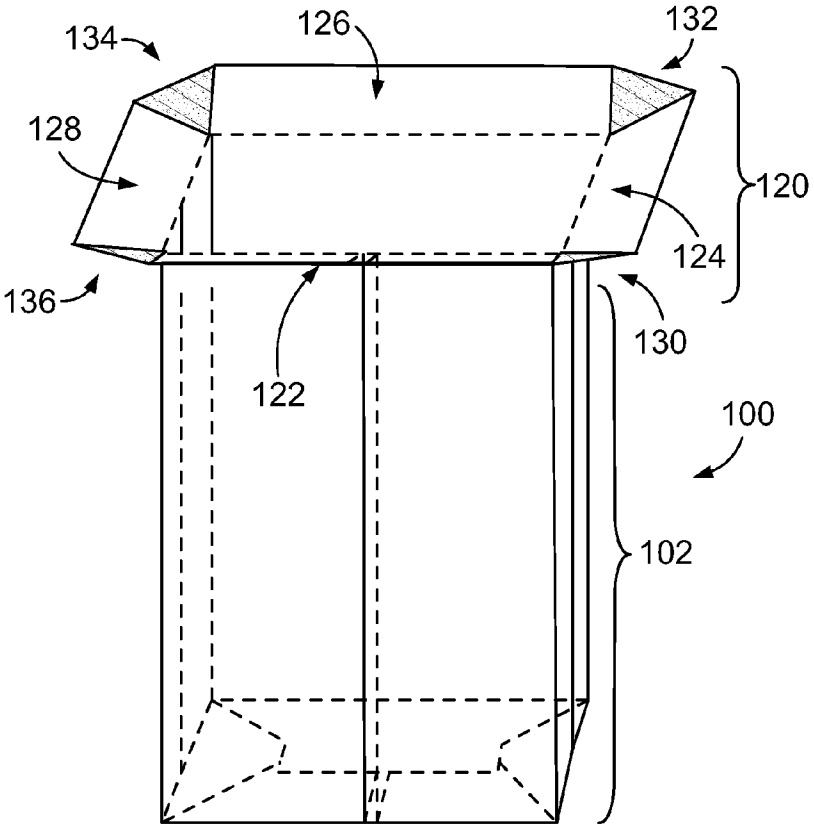
FIG. 2 shows the same bag as shown in FIG. 1 except in an expanded configuration that creates the funnel-shaped structure
Figure 1:
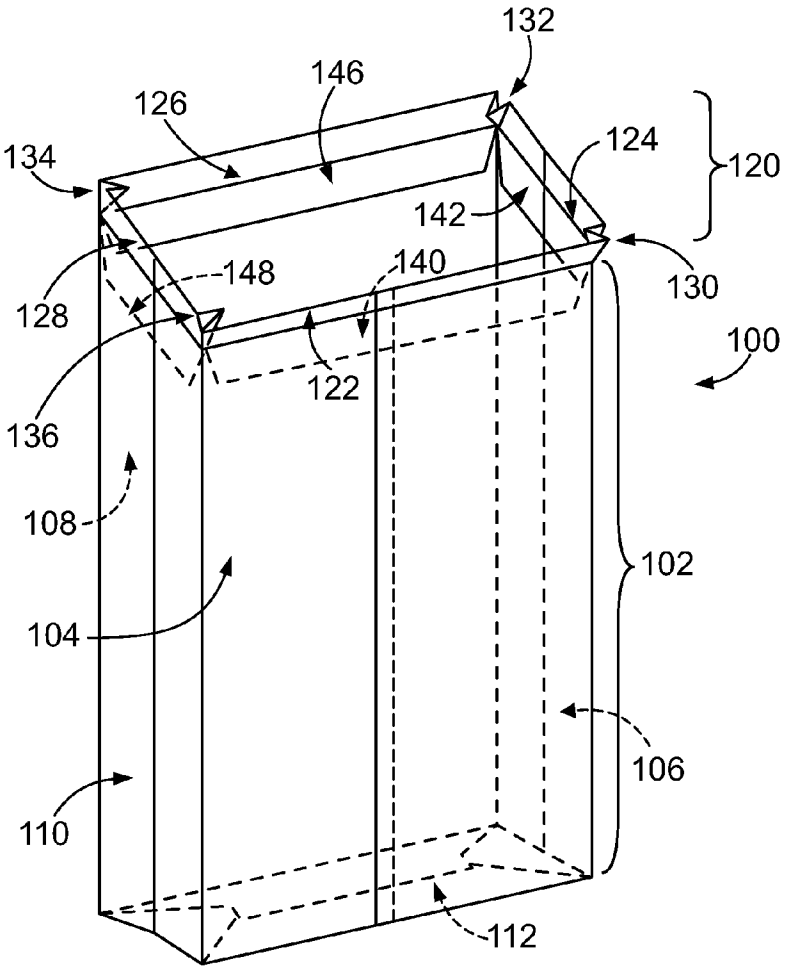
FIG. 1 shows a finished bag with the adapter piece attached.

FIGS. 1 and 2 illustrate a free-standing bag 100 according to an exemplary embodiment. In FIG. 1, the triangular connector sections 130-136 at the corners of the bag are folded inward so that the bag has the form factor of traditional bags; i.e. a rectangular shape with a bottom panel and an opening at the top. By unfolding the triangular connector sections, a wider, funnel-shaped opening is formed. FIG. 2 illustrates the free-standing bag 100 once the upper portion is unfolded to create the funnel-shaped opening.

In FIGS. 1 and 2 the lower portion of the bag 100 includes a plurality of lower side sections and a bottom section that are connected to form a tubular lower cavity. More specifically, as shown in FIG. 1, the lower portion 102 preferably includes four side sections 104-110, with two opposing long sides 104, 108 parallel to each other, and two opposing short sides 106, 110 that are also parallel. As shown, the four side sections 104-110 are connected so as to define a lower cavity within the lower portion of the bag, with the bottom section 112 connected to the four side sections 104-110 so as to close the lower cavity at the bottom of the bag. As further shown, the lower cavity is preferably a tubular cavity having a rectangular cross-section.

The upper portion of the bag includes a plurality of upper side sections, a plurality of insert sections, and a plurality of connector sections. As shown, the upper portion 120 includes four rectangular side sections 122-128, with two rectangular long sides 122, 126 that are parallel to each other, and two rectangular short sides 124, 128 that are also parallel. As shown, the four connector sections 130-136 connect the four side sections 122-128 such that the upper portion can be expanded to provide a funnel-shaped opening to the bag by unfolding the connector sections 130-136. Further, the upper portion 120 preferably includes four insert sections 140-146, with one extending from each side section towards the lower portion of the bag. Each insert section 140-146 is preferably affixed by adhesive or other means to a corresponding lower side section 104-110, such that a lower edge of each upper side section 122-128 abuts an upper edge of a corresponding lower side section 104-110.

Figure 3A:
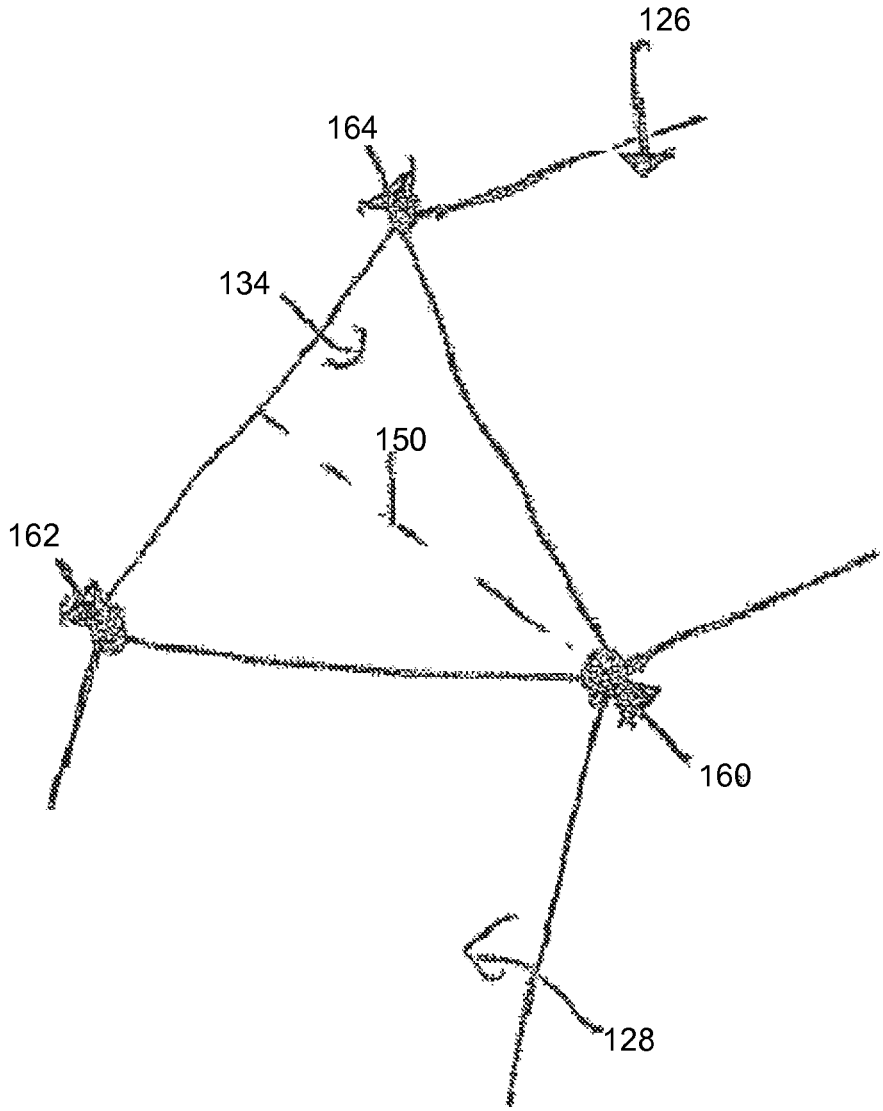
FIG. 3A shows a top-down view of a connector section in an expandable upper portion of an exemplary bag.

As noted, the upper portion 120 of the bag includes foldable connector sections 130-136 that allow the upper portion 120 of the bag to be expanded to create a funnel-shaped opening. To illustrate, FIG. 3A shows a more-detailed top-down view of one foldable connector section 134, which connects upper side sections 126 and 128. In FIG. 3A, the connector section 134 is shown in an unfolded position, which provides a funnel-shaped opening to the bag. Preferably, the connector section 134 is an equilateral triangle with a corner 160 that connects a lower corner of side section 128 and a lower corner of side section 126. The other two corners 162 and 164 are connected to only one side section (side section 126 and side section 128, respectively). When the connector sections 130-136 are unfolded, upper side sections 130-136 angle outward from the lower side sections 104-110 to form the funnel-shaped opening.

Figure 3B:
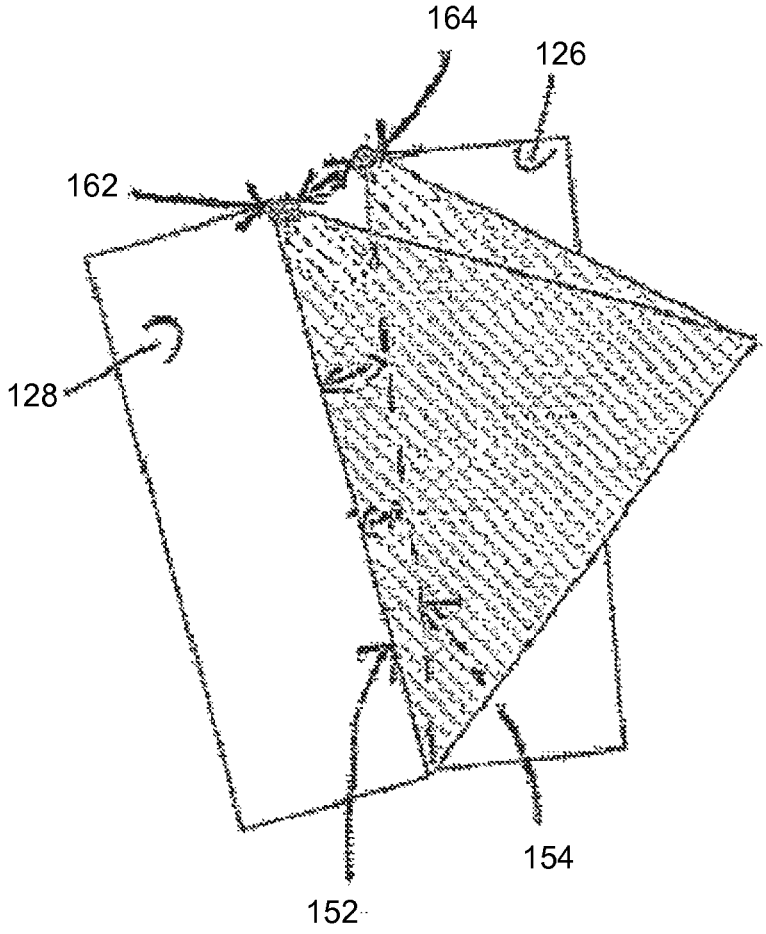
FIG. 3B shows an angular view of a connector section in an expandable upper portion of an exemplary bag.

Further, the connector section 134 preferably has a crease 150, which allows the connector section 134 to be folded inward and upon itself, as shown in FIG. 3B. Preferably, crease 150 bisects the connector section 134 (i.e., bisects the equilateral triangle), such that when the connection section 134 is folded inward to the upper cavity, the corners 162 and 164 of the connector section are brought together, so that edge 152 of side section 128 is substantially flush against the edge 154 of side section 126. As such, when the connector sections 130-136 are folded inward, the edges of upper side sections 122-128 form a substantially rectangular shape, and in effect extend lower side sections 104-110 to form a single rectangular cavity.

Figure 4A:
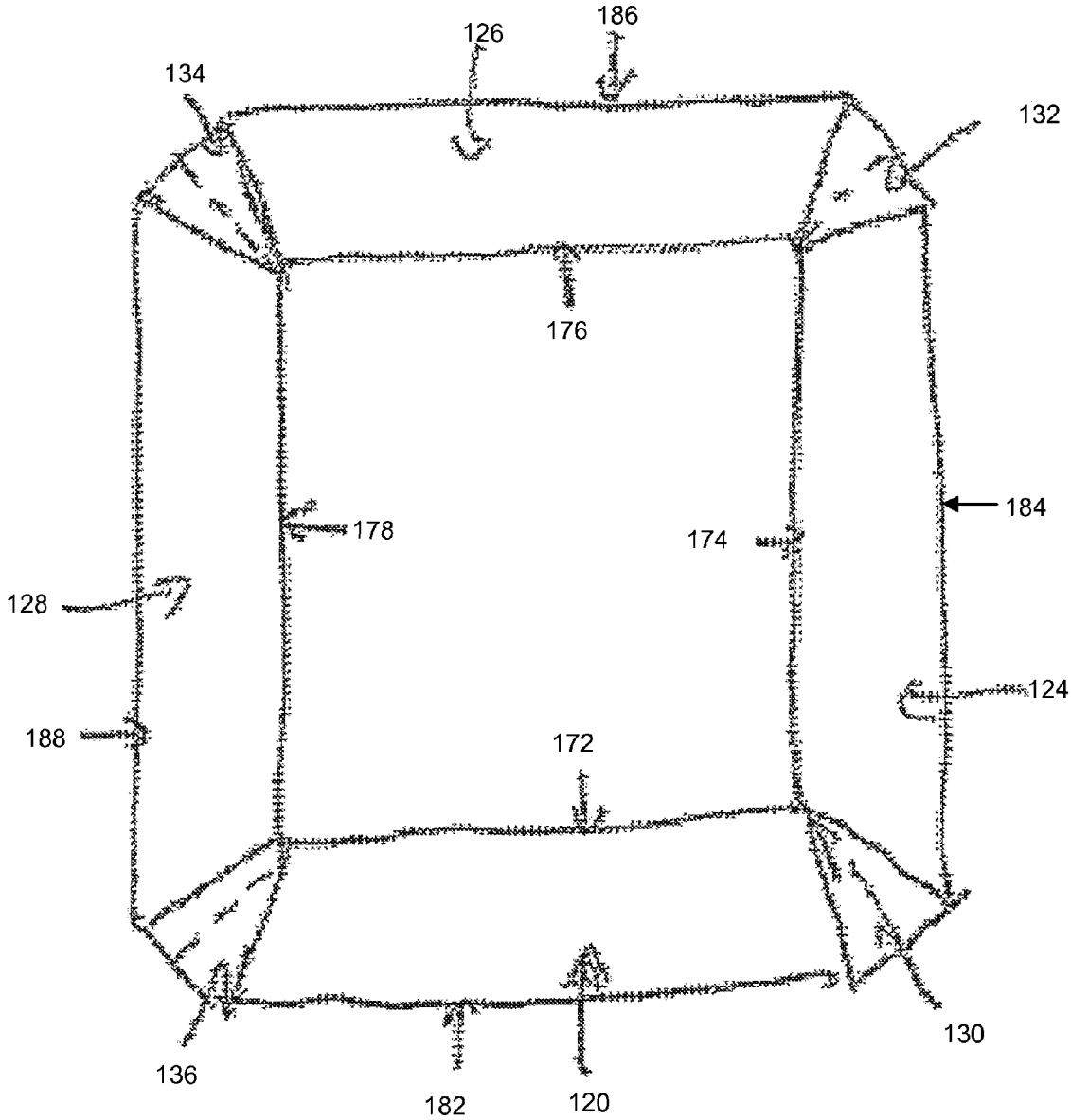
FIG. 4A shows an expandable upper portion of an exemplary bag in an expanded state.

FIG. 4A shows a top-down view of the upper portion 120 of the bag when connector sections 130-136 are unfolded. The cavity defined within the upper side sections 122-128, may be referred to as the upper cavity, and the cavity within the lower side sections 104-110 may be referred to as the lower cavity. As such the upper cavity is open at both ends, and defined as the space between a lower opening, which is defined by lower edges 172-178 of upper side walls 122-128, and an upper opening, which is defined by the upper edges 182-188 of upper side walls 122-128 and the upper edges 190-196 of connector sections 130-136.

The lower opening of the upper cavity, which is proximate to the lower cavity that is defined by lower side walls 104-100, preferably has a cross-section that is substantially the same size as a cross section of the lower cavity. In other words, the rectangle formed by the lower edges 172-178 of the upper side sections 122-128 is of substantially the same dimensions and orientation as the rectangle formed by the lower side sections 104-110. However, as shown, when the connector sections 130-136 are unfolded, the upper opening, which is distal to the lower cavity, is larger than the lower opening, as the upper edges 182-188 of upper side walls 122-128 and the upper edges 190-196 of connector sections 130-136, together, form an octagonal opening having a greater area than the rectangular opening formed by the lower edges 172-178 of the upper side sections 122-128. As such, when the upper portion is expanded, the upper side walls 122-128 angle outward from the lower edges 172-178, where the upper side walls 122-128 connect to lower side walls 104-110, thus defining a funnel-shaped upper cavity, which opens into the rectangular lower cavity.

Figure 4B:
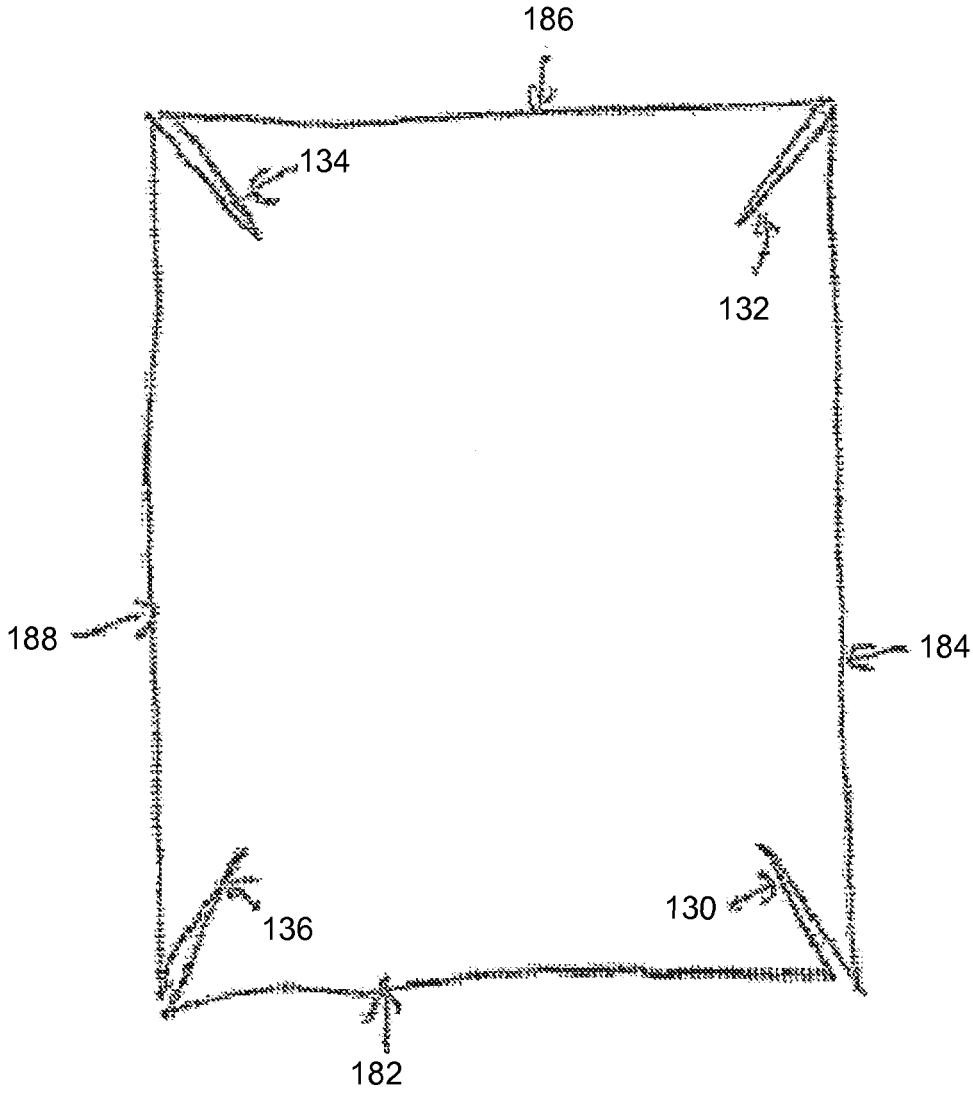
FIG. 4B shows an expandable upper portion of an exemplary bag in an unexpanded state.

FIG. 4B shows a top-down view of the upper portion 120 of the bag when the connector sections 130-136 are folded inward. Once the connector sections 130-136 are folded, the upper opening of the upper cavity is a substantially rectangular opening. Further, since each upper side section 122-128 is rectangular, both the lower opening and the upper opening are substantially the same size. As such, the upper cavity is tubular, and in the illustrated embodiment, is a rectangular cavity with a cross section that is the same size as a cross section of lower cavity. Thus, when the connector sections 130-136 are folded inward, the upper and lower cavities preferably form one contiguous rectangular cavity.

Figure 4C:
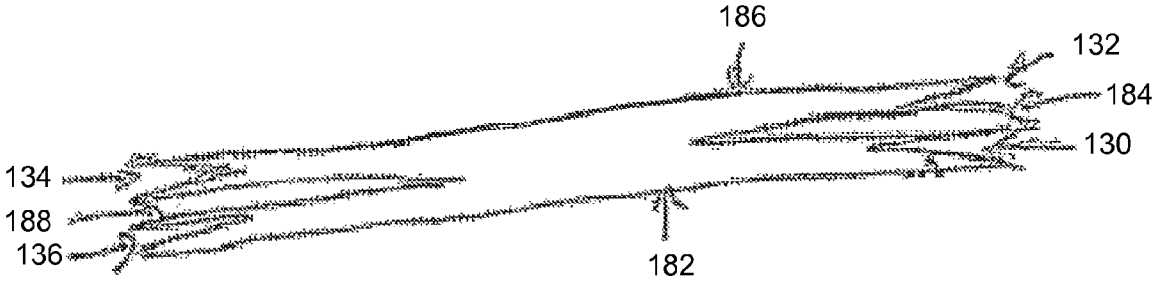
FIG. 4C shows a top-down view of an expandable upper portion of an exemplary bag folded to be substantially flat.

Referring back to FIGS. 1 and 2, in a further aspect, free-standing bag 100 may include creases such that the bag folds to a substantially flat shape. In particular, when connector sections 130-136 are folded inward, each upper side section 122-128 and its corresponding lower side section 104-110 effectively form a single rectangular side section. Folded as such, the bag 100 has a single rectangular cavity defined by four side walls and a bottom section, and thus takes on substantially the same form as traditional bags (albeit with the connector sections extending inward to the upper cavity). Crease patterns that allow traditional bags to fold flat are well known in the art. Accordingly, standard crease patterns may be applied to the lower portion 102 of bag 100, such as those shown by the dotted lines in the lower side sections 104-110 in FIGS. 1 and 2. As the connector sections 130-136 allow the upper portion to be folded so that the bag has the same form factor as a traditional bag, standard crease patterns may be extended through the upper portion 120 of the bag, as shown by the dotted lines in upper side sections 122-128. These standard crease patterns, along with the creases in the connector sections 130-136, allow the bag 100 to fold into a substantially flat rectangular shape, as shown by the top down view of the upper portion 120 shown in FIG. 4C. It should be understood that other crease patterns may be employed, without departing from the scope of the invention.

Figure 5:
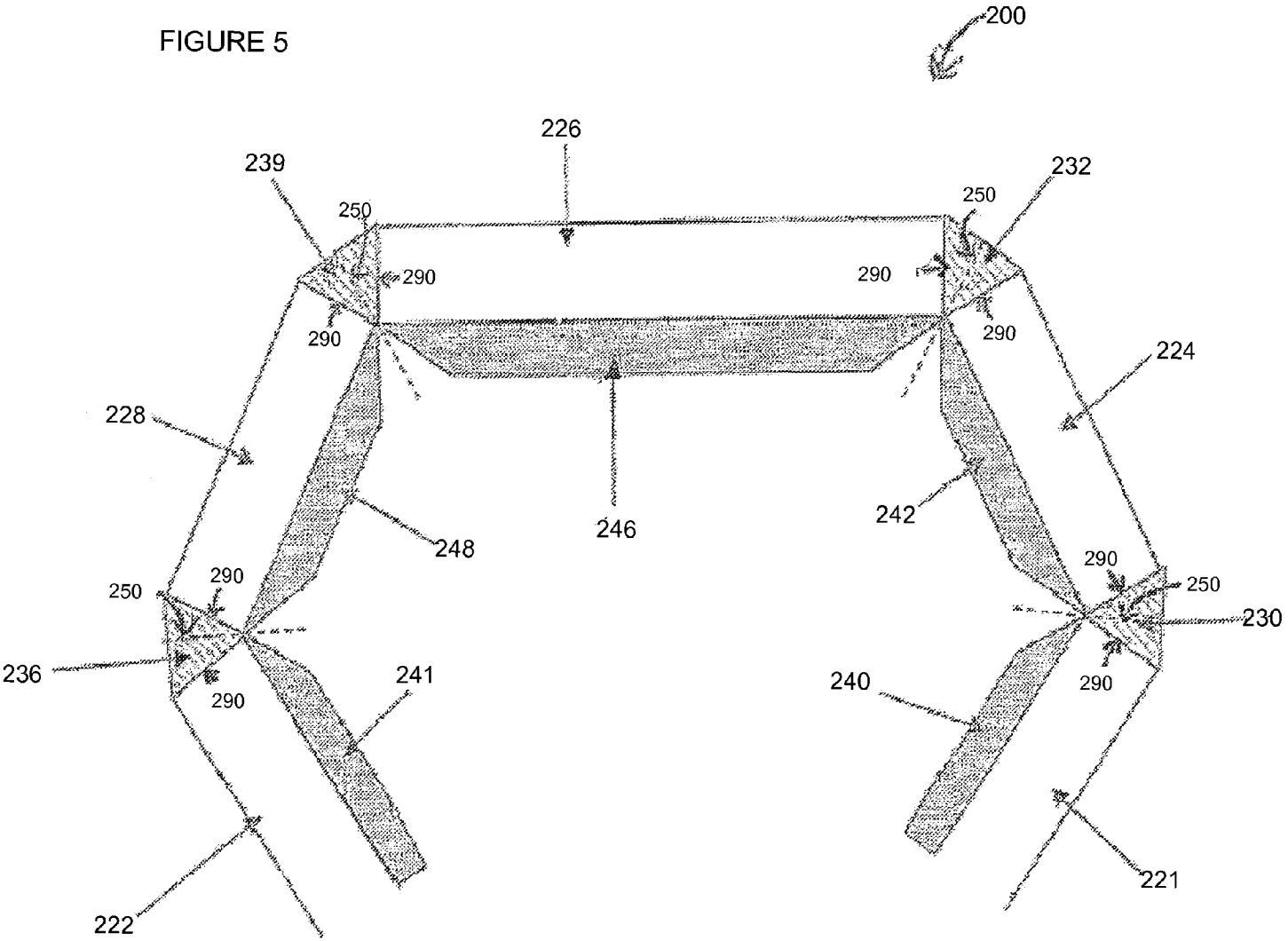
FIG. 5 shows the basic die-cut contiguous shape made out of a sheet of single or double-ply paper that becomes the basis of the adapter piece with all the appropriate folds.

In a further aspect, the upper portion 120 of the bag 100 (including the upper side sections, insert sections, and the connector sections, is preferably cut from a single piece of flat material. In particular, a die or other cutting technique may be used to a shape from a single piece of flat material that can manipulated to create the funnel-shaped upper portion 120. FIG. 5 illustrates a single piece of material cut into a shape 200 according to an exemplary embodiment, from which the upper portion 120 may be created. As shown, creases may be made in the shape 200 in order to define rectangular sections 221-228, which are connected by triangular sections 230-236. Further, creases may be made to define trapezoidal sections 240-248 which extend inward from the rectangular sections 221-228. Further, each triangular section 230-236 includes a crease 250 that bisects the equilateral triangle.

Preferably, the flat shape 200 is cut, and the creases are such, that triangular sections 230-236 are equilateral triangles. As shown, when the rectangular sections 221-228 are connected by equilateral triangles, the inner edges of rectangular sections 221-228 form a hexagonally-shaped inner wall. More specifically, as there are five rectangular sections 221-228, the inner wall defines five sides of a hexagon, with the sixth side (opposite rectangular section 246) being open. Furthermore, since the triangular sections 230-236 are equilateral, the hexagonal shape is be symmetrical; i.e. the inner edge of rectangular section 222 is of the same length and parallel to the inner edge of rectangular section 224, the inner edge of rectangular section 221 is of the same length and parallel to the inner edge of rectangular section 228, and the inner edge of rectangular section 226 is of the same length and parallel to the open side of the hexagon.

It should be understood, however, that triangular sections 230-236 may not be equilateral triangles. For example, the triangular sections may be isosceles triangles, in order to provide may provide a wider or narrower opening, depending on the form of the isosceles triangle. In particular, if the two equal angles of the isosceles triangle are less than sixty degrees, then the opening will be larger than if the triangular sections are equilateral, and if the two equal angles of the isosceles triangle are greater than sixty degrees, then the opening will be smaller than if the triangular sections are equilateral. Further, in embodiments where the triangular sections are not equilateral, the inner wall of the flat shape may still be hexagonal, albeit not symmetrical. For example, if the triangular sections are isosceles triangles, and if the two equal angles of the isosceles triangle are less than sixty degrees, then the inner edge of rectangular section 226 may be shorter than the opening in the inner wall that is opposite and parallel to it. Other examples are also possible.

Figure 6:
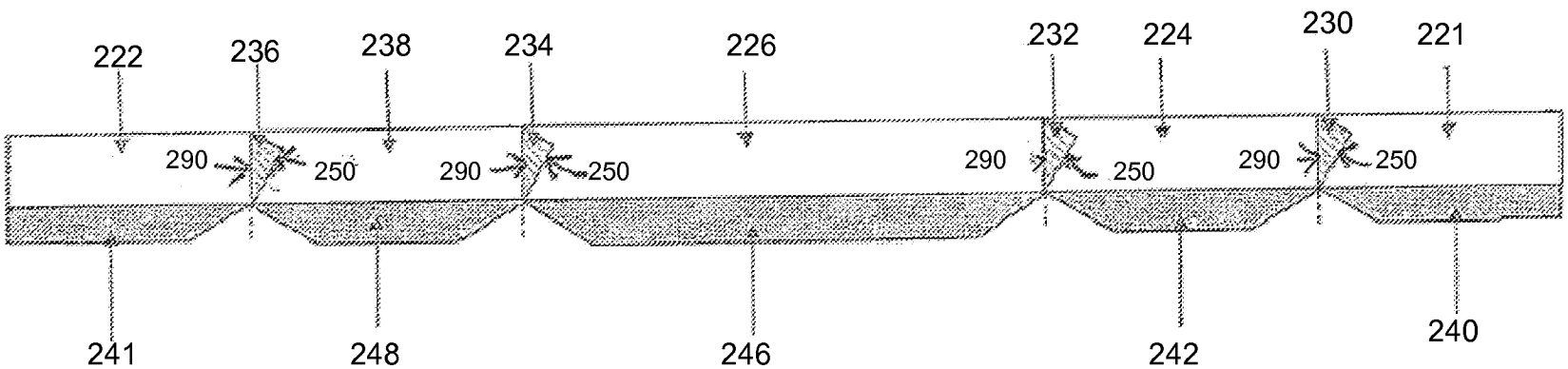
FIG. 6 shows the creation of a linear adapter piece out of the original die-cut shape shown in FIG. 5.
Figure 7A:
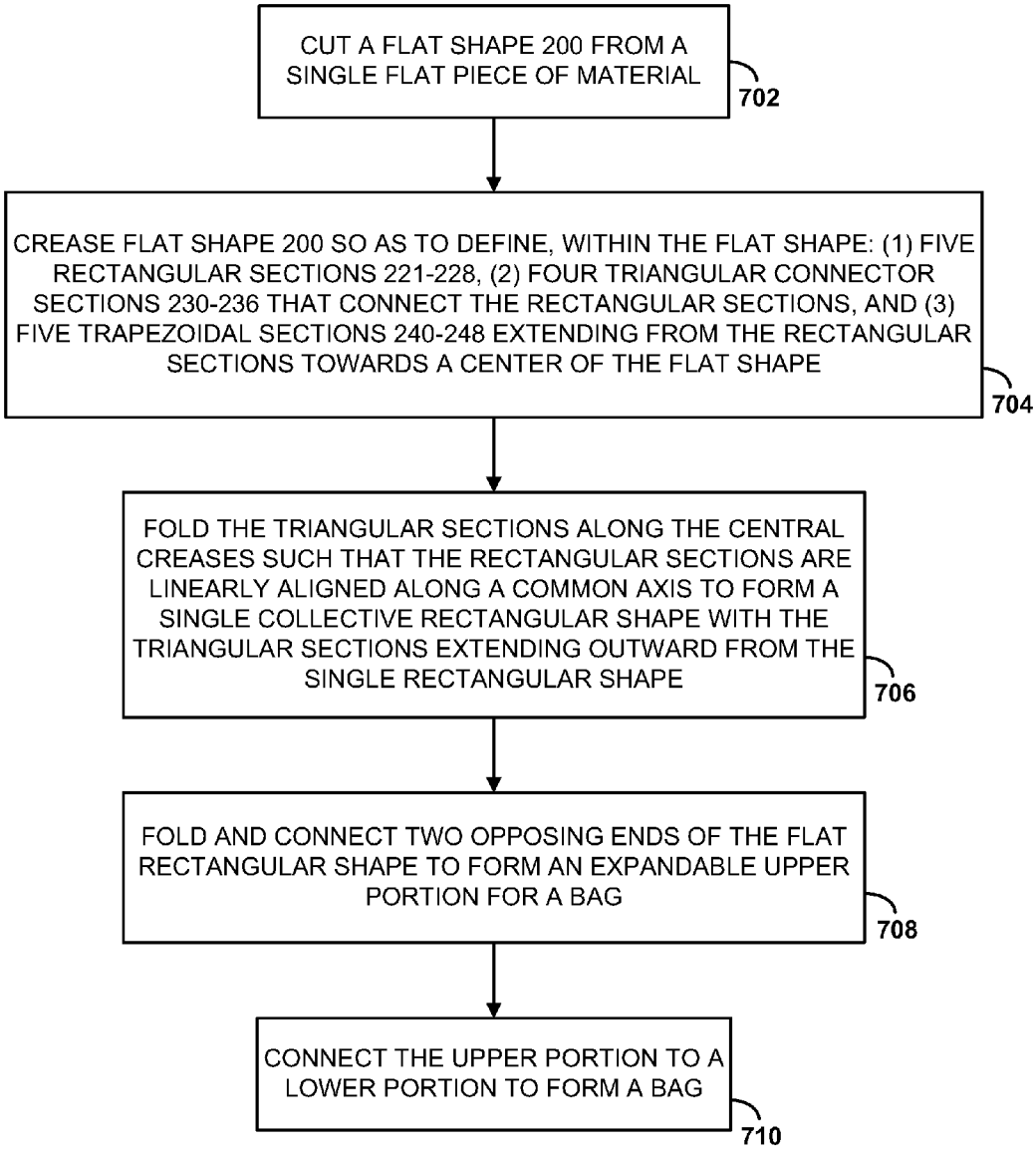
FIG. 7A is a flow chart illustrating a method for manufacturing a bag, according to an exemplary embodiment.

FIG. 7A is a flow chart illustrating a method for manufacturing a bag, according to an exemplary embodiment. As shown, the method involves cutting a flat shape (such as the shape shown in FIG. 5), from a single flat piece of material 200, as shown by block 702. The flat shape is then creased so as to define, within the flat shape: (1) five rectangular sections (e.g. sections 221-228), (2) four triangular connector sections that connect the rectangular sections (e.g., sections 230-236), and (3) five trapezoidal sections extending from the rectangular sections towards a center of the flat shape (e.g., trapezoidal sections 240-248), as shown in step 704. Preferably, each triangular section comprises a central crease dividing the triangular section and allowing the triangular section to be folded upon itself. Accordingly, as shown in step 706, the method further involves folding the triangular sections along the central creases such that the rectangular sections are linearly aligned along a common axis to form a single collective rectangular shape with the triangular sections extending upward from the single rectangular shape. As shown by step 708, once triangular connector sections 230-236 have been folded so that a shape such as that shown in FIG. 6 is formed, the method involves folding and connecting two opposing ends of the flat rectangular shape (e.g., the end of the shape defined by sections 222 and 241, and the end of the shape defined by sections 221 and 240), such that the shape forms an expandable upper portion of the bag as described herein. This upper portion may then be connected to a lower portion to form the bag, as shown by block 710.

More specifically, in order that the piece of material 200 having the shape shown in FIG. 5 be formed into an upper portion 120, which is expandable to provide a funnel-shaped opening, the following may be performed. First, the triangular sections 230-236 may be folded inward along creases 250, such that rectangular sections 221-228 are linearly aligned along a common axis, as shown in FIG. 6.

The shape 200 may then be folded at right angles along the creases 290, and rectangle 221 may be connected to rectangle 222 to form a single rectangle of the same dimensions as rectangle 226. By so doing, shape 200 is now arranged as upper portion 120. Specifically, rectangles 222-226 are arranged to serve as upper side sections 122-128 in upper portion 120, and the single rectangle formed by rectangles 221 and 222 is arranged to serve as upper side section 122. Further, the trapezoidal sections 240-246 are arranged to serve as insert sections 140-146, and the triangular sections 230-236 are arranged to serve as connector sections 130-136. Additionally, creases 250 and 290 allow the triangular sections to expand to define a funnel-shaped cavity, and fold inward to define a rectangular cavity.

Note that when the triangular sections 230-236 are folded so as to extend upward, as in FIG. 6, this results in the triangular sections extending inward to the bag once the manufacturing process is completed. In particular, once the upper portion is connected to the lower portion of the bag with trapezoidal sections 240-248 and the bag is folded and connected such that rectangular sections 221 and 222 are connected to form one side of the upper portion of the bag, triangular sections 230-236 will extend inward.

In the manufacturing of an upper portion from a single piece of material, it should be understood that once rectangles 221 and 222 connected to form an upper side section, the upper side section is preferably of the same dimensions as rectangle 226, which serves as the opposing upper side section of the upper portion of the bag. However, the combined width of rectangles 221 and 222 is preferably greater than the length of rectangle 226, so that rectangles 221 and 222 can be overlapped in order that the rectangles be adhered to each other to form an upper side section. Further, it should be understood that the widths of rectangles 221 and 222 may vary, so long as rectangles 221 and 222 can be connected to form an upper side wall having the same dimensions as rectangle 226. Further, it is possible that rectangles 221 and 222 may be replaced by a single rectangular section that can be connected to a triangular section in order to form the upper portion of the bag.

Figure 7B:
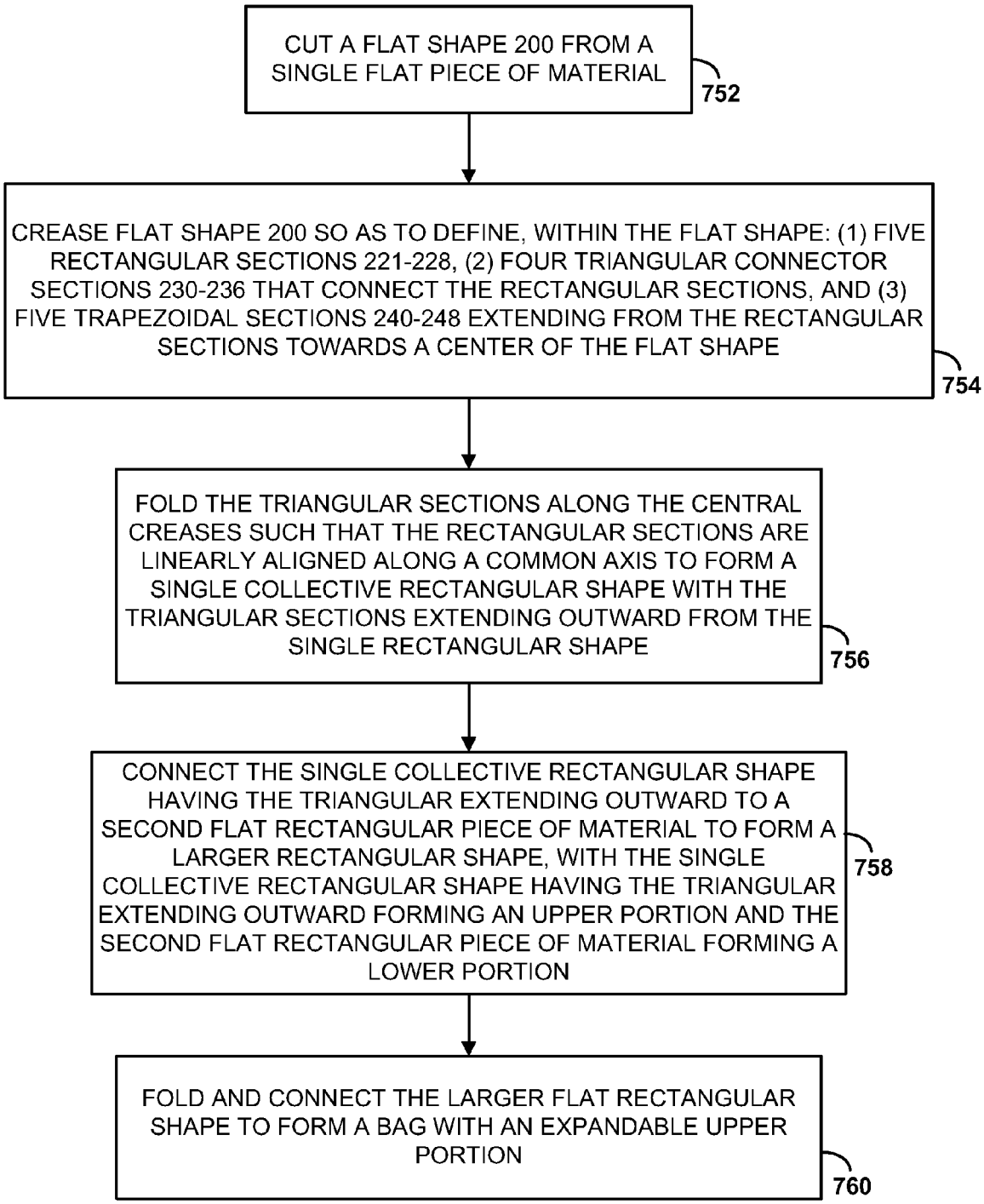
FIG. 7B is a flow chart illustrating another method for manufacturing a bag, according to an exemplary embodiment.

FIG. 7B is a flow chart illustrating another method for manufacturing a bag, according to an exemplary embodiment. In FIG. 7B, steps 752-756 are carried out in the same or similar manner as steps 702-706 of FIG. 7A. However, as shown by step 758, the single collective rectangular shape having the triangular sections extending outward is connected to a second flat rectangular piece of material to form a larger rectangular shape, with the single collective rectangular shape having the triangular sections extending outward forming an upper portion and the second flat rectangular piece of material forming a lower portion. Then after the upper and lower portion have been connected, the larger rectangular shape is folded and connected to form a bag with an expandable upper portion, as shown by step 760.

Figures 8A, 8B:
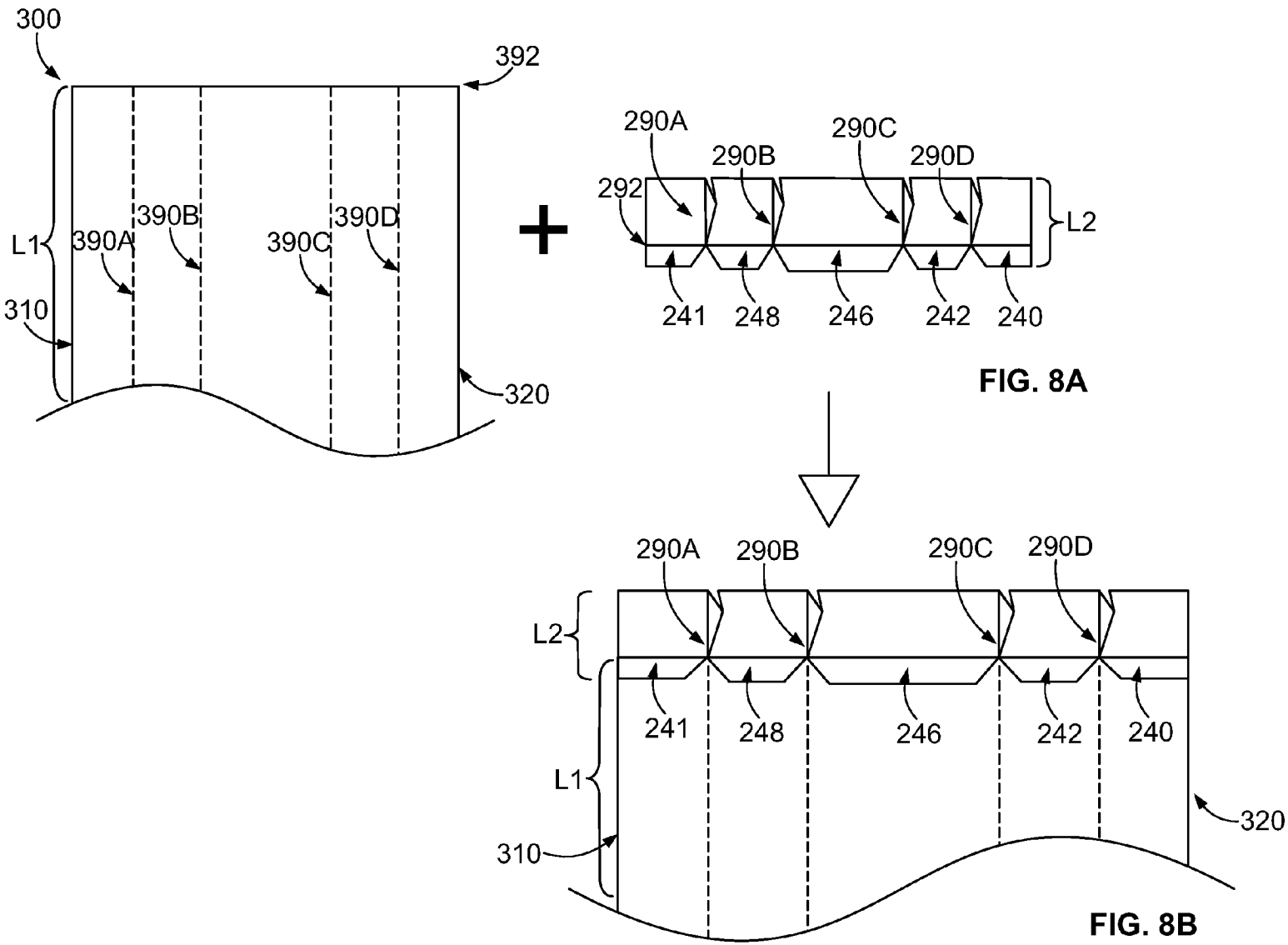
FIGS. 8A and 8B are block diagrams illustrating how an upper portion and lower portion of a bag may be connected, before being folded to create a cavity of the bag, according to an exemplary manufacturing method.

FIGS. 8A and 8B show how an upper portion and lower portion of the bag may be connected, before being folded to create a cavity of the bag, using a method such as that shown in FIG. 7B. More specifically, as shown in FIG. 8A, when the single piece of material 200 for the upper portion of the bag is folded as shown in FIG. 6, the trapezoidal sections 241-248 (i.e., insert sections) may be adhered to a second flat piece of material 300. The second flat piece of material 300 may be folded along creases 390A-390D (and possibly along other creases not shown) and adhered along sides 310 and 320 to form the lower portion of the bag. Preferably, the trapezoidal sections 241-248 are adhered such that an edge 292 formed by the rectangular sections 221-226 is substantially flush against an upper edge 392 of the piece of material 300 for the lower section, and such that creases 290A-290D of the upper portion of the bag align with creases 390A-390D of the lower portion, as shown in FIG. 8B.

Figure 9A:
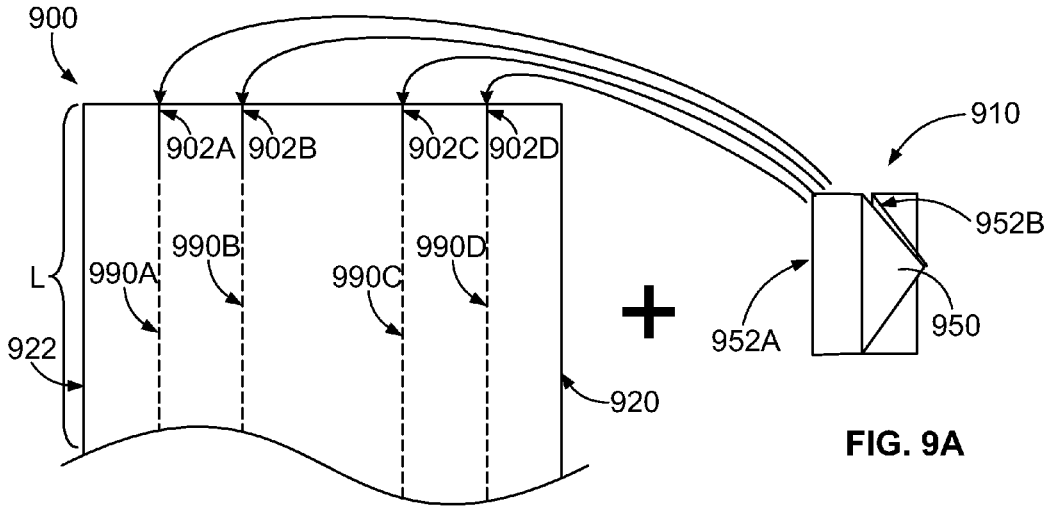
FIGS. 9A and 9B are block diagrams illustrating how an upper portion can be converted to an expandable opening using triangular connector sections, before being folded to create a cavity of the bag, according to another exemplary manufacturing method.
Figure 9B:
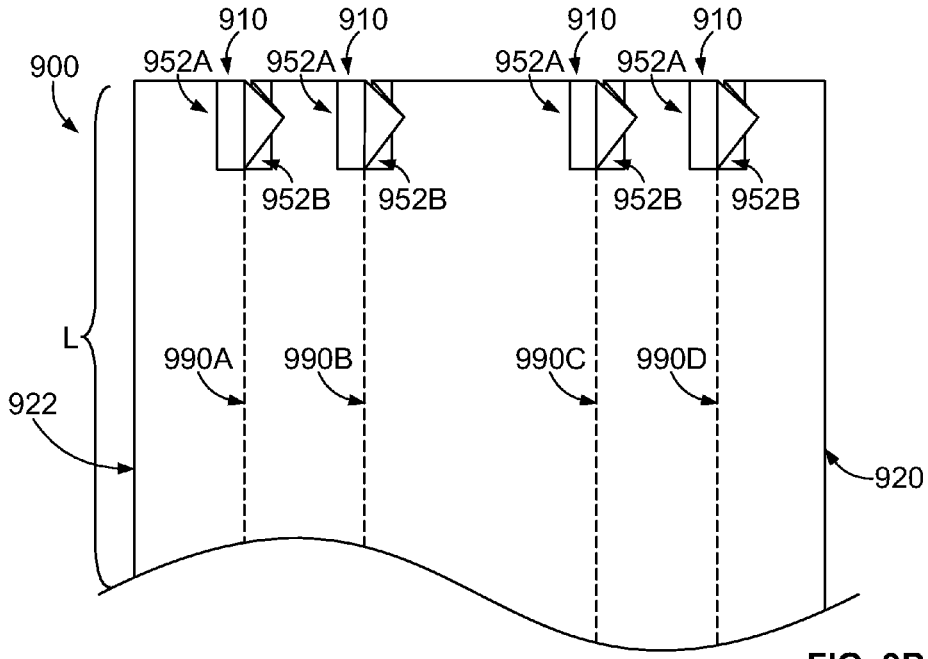

In an alternative embodiment, an exemplary paper bag including an upper portion and lower portion that function as described herein, may be formed from one or more pieces of material having the same form as the piece or pieces from which standard bags are formed, with the addition of four tabbed connector pieces. In particular, as shown in FIG. 9A, four slits 902A-D may be cut in a piece of flat material 900. Further, four tabbed connector sections 910 may be created. Each tabbed connector section 910 includes a foldable triangular connector 950 as described herein and two tabs 952A and 952B extending from the triangular connector section 950. The four tabbed connector sections 910 may then be adhered to either sides of the slits 902A-D, and tabs 952A and 952B adhered to piece 900, as shown in FIG. 9B. The piece 900 may then be folded along creases 990A-990D (and possibly along other creases not shown) and adhered along sides 910 and 920 to form the bag such that when the foldable triangular connectors 950 are folded, the connectors 950 extend inward to the bag.

Figure 7C:
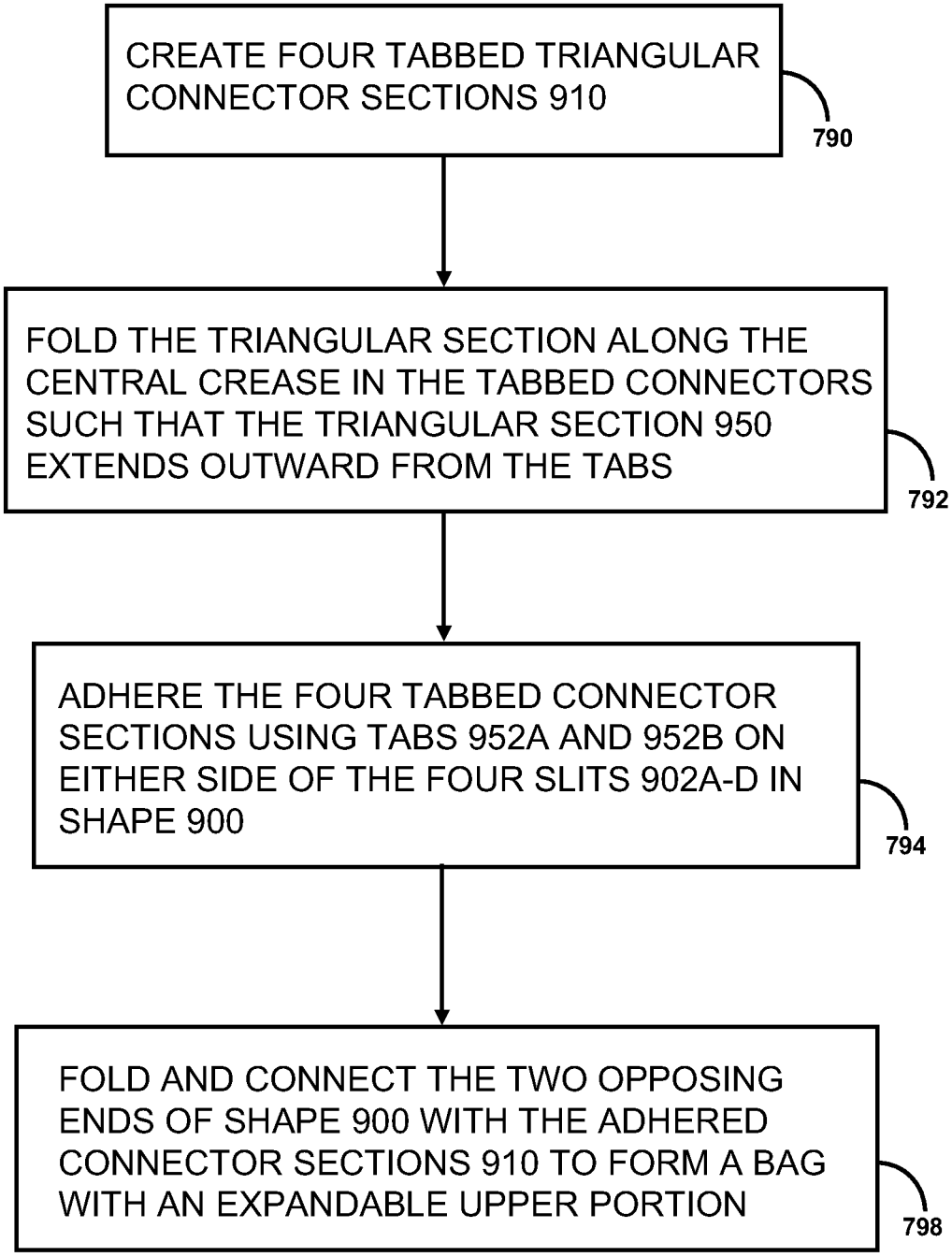
FIG. 7C is a flow chart illustrating another method for manufacturing a bag, according to an exemplary embodiment.

FIG. 7C is another flow chart illustrating method 790 for manufacturing a bag, according to an exemplary embodiment. In particular, steps 790-798 may be carried out to create a bag in the manner described in reference to FIGS. 9A and 9B, using four triangular connector having tabs, which are used to attach the triangular connector sections in slits of a rectangular piece, which can then be connected and folded into a bag in a similar manner as in FIG. 7B.

In another aspect of the invention, the invention may take the form of an expandable adapter piece, which provides a larger funnel-shaped opening for standard bags. The expandable adapter piece preferably takes the form of the upper portion of a bag as described herein. For example, the adapter piece may take the form of an upper portion of a bag as illustrated in FIGS. 1, 5, and 6, which includes insert sections, such as insert sections 240-248. The insert sections may be inserted along the side walls of a standard bag to connect the adapter piece to the standard bag. The insert sections may additionally or alternatively include other means for connecting the adapter piece to the standard bag. For instance, the insert sections may include adhesive for adhering the connector sections to the standard bag. Other variations for connecting the adapter piece to a standard bag are also possible.

It should be understood the arrangements and functions described herein are presented for purposes of example only, and that numerous variations are possible. For instance, elements can be added, omitted, combined, distributed, reordered, or otherwise modified.

I claim:

1. A free-standing bag comprising:

a lower portion comprising a plurality of lower side sections and a bottom section, wherein the lower side sections define a lower cavity, wherein the lower cavity is tubular; and an upper portion comprising:

a plurality of upper side sections;

a plurality of insert sections extending from the upper side sections and arranged to connect the upper portion to the lower portion; and a plurality of foldable connector sections that connect the upper side sections to define an expandable upper cavity, wherein each connector section comprises at least one crease for folding the connector section inward to the upper cavity;

wherein the connector sections are arranged such that when the connector sections are unfolded, the upper cavity is expanded and comprises:

a lower opening that is proximate to the lower cavity and substantially the same size as a cross section of the lower cavity; and an upper opening that is distal to the lower cavity and larger than the lower opening;

wherein the connector sections are further arranged such that when the connector sections are folded inward, both the lower opening and the upper opening are substantially the same size as a cross section of the lower cavity; and wherein the upper portion of the bag comprises a single piece of material comprising a plurality of cuts and creases arranged to provide the upper side sections, the insert sections, and the foldable connector sections, and wherein the lower portion of the bag comprises at least one separate piece of material.

2. The bag of claim 1, wherein the bag is a lawn bag for disposal of yard waste.

3. The bag of claim 1, wherein the bag is a paper bag.

4. The bag of claim 3, wherein the upper portion of the bag is manufactured from a single sheet of paper.

5. The bag of claim 1, wherein one or more of the side sections of the lower portion and one or more of the side sections of the upper portion are foldable, and wherein the lower portion and the upper portion are arranged such that, when the connector sections are folded inward, the bag folds to a substantially flat shape.

6. The bag of claim 5, wherein the substantially flat shape is a rectangular shape.

7. The bag of claim 1, wherein the connector sections are further arranged such that when the connector sections are folded inward and the upper cavity is tubular, the upper cavity extends the tubular lower cavity through the upper portion of the bag.

8. The bag of claim 1:

wherein the lower cavity portion is a rectangular tubular cavity;

wherein the upper cavity, when the upper portion is expanded, is a rectangular pyramidal cavity; and wherein the upper cavity, when the upper portion is not expanded, is a rectangular tubular cavity.

9. The bag of claim 8, wherein together, the lower cavity and the upper cavity form a single rectangular tubular cavity when the upper portion is not expanded.

10. An adapter piece for a free-standing bag comprising:

a plurality of upper side sections;

a plurality of insert sections extending from the upper side sections and arranged to connect the adapter piece to a bag; and a plurality of foldable connector sections that connect the upper side sections to define an expandable upper cavity, wherein each connector section comprises at least one crease for folding the connector section inward to the upper cavity;

wherein the connector sections are arranged such that when the connector sections are unfolded, the upper cavity is expanded and comprises:

a lower opening of substantially the same size as an opening at an upper end of the bag; and an upper opening that is larger than the lower opening, thereby defining a funnel-shaped cavity;

wherein the connector sections are further arranged such that when the connector sections are folded inward, both the lower opening and the upper opening are substantially the same size as the opening at the upper end of the bag; and wherein at least two opposing upper side sections have creases such that when the upper side sections are folded along the creases, and the connector sections are also folded inward to the cavity, the adapter folds to a substantially flat rectangular shape; and wherein the adapter piece comprises a single piece of material comprising a plurality of cuts and creases arranged to provide the upper side sections, the insert sections, and the foldable connector sections, and wherein the bag to which the adapter piece is connectable comprises at least one separate piece of material.

11. The adapter piece of claim 10, wherein the adapter piece is constructed from a single piece of material.

12. The adapter piece of claim 11, wherein the single piece of material is a single piece of paper.

13. The adapter piece of claim 10, wherein each foldable connector section further comprises a tab that attaches the connector section to the upper side section on either side of the foldable connector section.

* * * * *